US007308869B2

(12) United States Patent
Stone

(10) Patent No.: US 7,308,869 B2
(45) Date of Patent: Dec. 18, 2007

(54) RADIAL COMPRESSION-IGNITION ENGINE

(76) Inventor: Nicholas Mathew Stone, One Riverside Pl., No. 503, Covington, KY (US) 41011

( * ) Notice: Subject to any disclaimer, the term of this patent is extended or adjusted under 35 U.S.C. 154(b) by 28 days.

(21) Appl. No.: 11/233,792

(22) Filed: Sep. 23, 2005

(65) Prior Publication Data

US 2007/0068467 A1 Mar. 29, 2007

(51) Int. Cl.

| | |
|---|---|
| ***F01B 3/00*** | (2006.01) |
| ***F02B 57/08*** | (2006.01) |
| ***F02B 57/06*** | (2006.01) |
| ***F01L 1/04*** | (2006.01) |

(52) U.S. Cl. ..... 123/19; 123/45 R; 123/44 C; 123/90.6

(58) Field of Classification Search ..... 123/54.2, 123/44 C, 44 R, 19

See application file for complete search history.

(56) References Cited

U.S. PATENT DOCUMENTS

| | | | | |
|---|---|---|---|---|
| 1,019,222 | A * | 3/1912 | Cheeseman et al. | 123/44 C |
| 1,339,406 | A | 5/1920 | Milner et al. | |
| 1,347,731 | A | 7/1920 | Carmody | |
| 1,372,742 | A | 3/1921 | Dorman | |
| 1,793,652 | A | 2/1931 | Turnbull | |
| 1,866,281 | A | 7/1932 | Woolson | |
| 1,936,121 | A | 11/1933 | Skonieczny | |
| 1,951,320 | A | 3/1934 | Blanchard | |
| 1,975,600 | A | 10/1934 | Gosslau | |
| 2,057,164 | A | 10/1936 | Rockwell | |
| 2,088,215 | A * | 7/1937 | Podrabsky | 123/65 BA |
| 2,170,151 | A | 8/1939 | McCarthy | |
| 2,665,668 | A | 1/1954 | Ward | |
| 4,078,529 | A * | 3/1978 | Warwick | 123/44 C |

* cited by examiner

*Primary Examiner*—Stephen K. Cronin
*Assistant Examiner*—Hyder Ali
(74) *Attorney, Agent, or Firm*—Wood, Herron & Evans, L.L.P.

(57) ABSTRACT

A compression-ignition internal combustion engine for aircraft generally comprises a stationary crankshaft, a crankcase adapted to rotate about the stationary crankshaft, and a plurality of cylinders radially extending from the crankcase. Each cylinder includes a piston adapted to reciprocate therein and a connecting rod drivingly coupling the piston to the crankshaft. The engine further comprises a valve assembly for operating an exhaust valve associated with each cylinder and a fuel assembly for supplying fuel to each cylinder. First and second cams mounted on the crankshaft are adapted to operate the valve assembly and fuel assembly in a timed manner as the crankcase rotates about the crankshaft. The engine also includes a propeller synchronizer for adjusting the pitch of a plurality of propellers radially extending from the rotating crankcase.

19 Claims, 9 Drawing Sheets

RADIAL COMPRESSION-IGNITION ENGINE

FIELD OF THE INVENTION

The present invention relates generally to internal combustion engines, and more particularly, to a radial compression-ignition engine for aircraft.

BACKGROUND OF THE INVENTION

Internal combustion engines, and more specifically, reciprocating internal combustion engines are well known in the art. A conventional internal combustion engine typically includes a crankshaft, a crankcase disposed about the crankshaft, one or more cylinders exposed to the crankcase, a piston adapted to reciprocate within each cylinder, and a connecting rod drivingly coupling each piston to the crankshaft. The crankcase may be fixed to the frame of a vehicle such that the reciprocation of the pistons causes the crankshaft to rotate about an axis. Alternatively, the crankshaft may be fixed to the frame of a vehicle such that the reciprocation of the pistons causes the crankcase and cylinders to rotate about the crankshaft. Both of these configurations were commonly used to power aircraft in the early days of aviation. In particular, engines having the latter configuration with several cylinders radially disposed about the crankshaft were often referred to as "Gnome"-type engines.

Reciprocating internal combustion engines may be further classified as being spark-ignited (SI) or compression-ignited (CI). SI engines control the start of combustion by appropriately timing a spark plug that ignites an air-fuel mixture in the cylinder. The spark plug is often timed such that the start of combustion occurs when the piston reaches the top of the cylinder. To this end, the compression ratio of the engine must be kept relatively low in order to avoid engine "knock," or the premature ignition of the air-fuel mixture. Traditional gasoline engines are typically of the SI type.

CI engines, on the other hand, control the start of combustion by compressing air within the cylinder and directly injecting fuel into the compressed air. Typically diesel fuel is injected into the compressed air, which is why traditional diesel engines are of the CI type. The increased pressure raises the temperature in the cylinder and eventually causes the air-fuel mixture to self-ignite. Such an arrangement requires CI engines to achieve higher compression ratios, and therefore, higher thermal efficiencies than comparable SI engines. In other words, traditional diesel engines are capable of more horsepower (BTUs) per volume of fuel when compared to their traditional gasoline counterparts. With the ever-increasing costs of gasoline, this aspect of a traditional diesel engine is particularly appealing to manufacturers and consumers of airplanes and other vehicles that consume large quantities of fuel.

Although several early attempts were made to develop a suitable CI or diesel engine for propeller-driven aircraft, there are many challenges associated with using these engines to power such aircraft. For example, combustion of the highly compressed air-fuel mixture in the cylinders can cause the pistons to generate significant shock "pulses" throughout the engine. These pulses can cause the engine to vibrate and thus lead to unsafe operating conditions. To reduce vibrations, CI engines are typically designed with heavier cylinders and crankcases to dampen the effect of the pulses. The additional weight, however, limits the aircraft's speed and altitude ability and thus has hereto before discouraged the use of CI engines in airplanes and other aircraft.

Maintenance difficulties are another challenge often associated with CI engines. For example, CI engines typically have a two-piece construction including a heavy cylinder head, a head gasket, and heat bolts coupling the cylinder head with the cylinder body. The cylinder head, head gasket, and head bolts are known to be common sources of failure because they are continuously exposed to the tremendous pressures associated with the cylinders.

In summary, the increased weight and maintenance challenges associated with CI engines has discouraged their use in the aircraft industry. Those in the industry abandoned attempts to capitalize on the advantages of CI engines and have instead relied upon SI engines due of their lighter weight. This is particularly true in the light to medium aircraft market. Moreover, over the past several decades there has been a significant trend towards using "jet-propelled" aircraft. Jet-propelled aircraft are typically powered by a gas turbine instead of the Si and CI reciprocating engines discussed above. Gas turbine engines generally experience much higher combustion temperatures than reciprocating engines and are adapted to deliver more power when compared to a reciprocating engine of the same weight.

Although jet engines have helped address some of the drawbacks associated with reciprocating engines, the solutions have come at an enormous cost to aircraft owners. For example, gas turbines often require complex designs and expensive materials because of the high combustion temperatures. Gas turbines can also be more costly to fuel than comparable reciprocating engines.

Therefore, there is a need for an improved compression-ignition engine that addresses the design challenges discussed above in order to provide an effective alternative to Si engines and an inexpensive alternative to gas turbine engines.

SUMMARY OF THE INVENTION

The present invention provides a compression-ignition internal combustion engine for aircraft or the like. The engine generally comprises a stationary crankshaft, a crankcase positioned about the crankshaft, and a plurality of cylinders radially extending through a plurality of ports in the crankcase. Each cylinder includes a piston adapted to reciprocate therein and a connecting rod drivingly coupling the piston to the crankshaft. Because the engine is a Gnome-type engine, the crankcase and cylinders are adapted to rotate about the stationary crankshaft. The crankcase and cylinders also have a unitary construction in order to reduce the overall weight of the engine and eliminate the need for head gaskets and other sources of engine failure. Accordingly, the engine may be used to power propeller-driven aircraft by attaching a plurality of propeller blades to the rotating crankcase.

An engine according to the invention further includes a valve assembly and fuel assembly associated with the cylinders. The valve assembly includes an exhaust valve associated with each cylinder, a valve tappet associated with each exhaust valve, and a valve housing coupled to the crankcase for aligning the valve tappets with a first cam mounted on the crankshaft. The valve tappets are adapted to cooperate with the first cam in order to operate the exhaust valves in a timed manner as the crankcase rotates about the crankshaft. In one aspect of the invention, the first cam only has one lobe for cooperating with the valve tappets such that the exhaust valves operate once per revolution of the crankcase about the crankshaft.

Similarly, the fuel assembly includes a fuel injector associated with each cylinder, a plurality of fuel pumps corresponding to the plurality of cylinders, and a fuel assembly housing coupled to the crankcase for aligning the fuel pumps with a second cam mounted on the crankshaft. The fuel pumps are adapted to cooperate with the second cam to provide pressurized fuel to the fuel injectors in a timed manner as the crankcase rotates about the crankshaft. Like the first cam, the second cam has only one lobe for cooperating with the fuel pumps such that the fuel injectors operate once per revolution of the crankcase about the crankshaft.

In one embodiment, a starter motor and an air blower are mounted to the crankshaft. The starter motor is selectively coupleable to the crankcase and adapted to rotate the crankcase when coupled thereto. Meanwhile, the air blower is coupled to the crankcase by a drive belt such that the air blower is powered by the rotation of the crankcase. The air blower is adapted to deliver pressurized air through a hollow portion of the crankshaft and into the crankcase. From there, the pressurized air is delivered to the plurality of cylinders by an air manifold.

The invention also provides a propeller synchronizer for selectively adjusting the pitch of the propellers. The propeller synchronizer is generally positioned within the spinner of the engine, and generally comprises a motor secured to the crankcase, a pinion gear rotatably coupled to the motor, a main synchronizer gear operable to rotate relative to the crankcase and coupled to each propeller, and a drive shaft coupling the pinion gear to the main gear such that operation of the motor causes rotation of the propellers so as to change their pitch.

These and other objects, advantages and features of the invention will become more readily apparent to those of ordinary skill in the art upon review of the following detailed description.

BRIEF DESCRIPTION OF THE DRAWINGS

The accompanying drawings, which are incorporated in and constitute a part of this specification, illustrate embodiments of the invention and, together with a general description of the invention given above, and the detailed description given below, serve to explain the principles of the invention.

DETAILED DESCRIPTION

Figure 1:
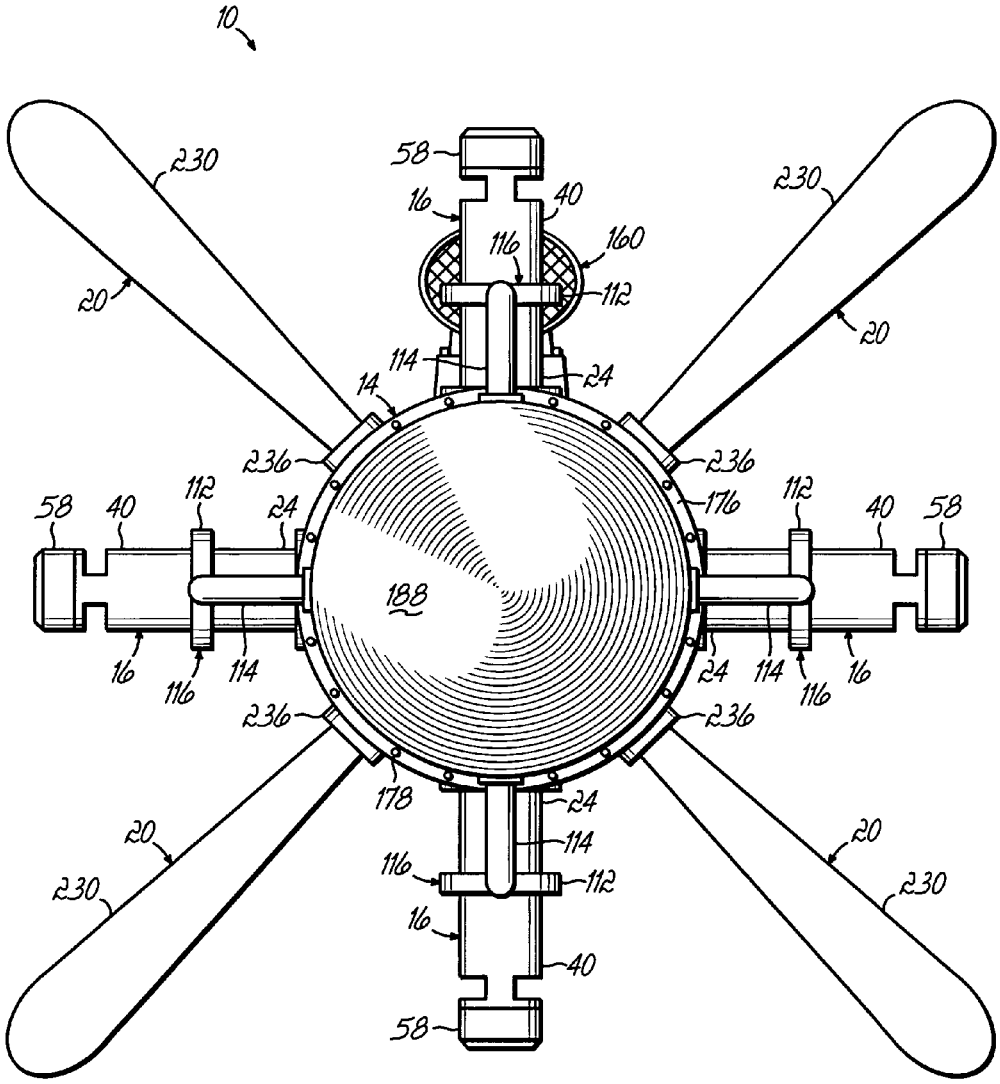
FIG. 1 is a schematic view showing the front of an engine according to an embodiment of the invention.
Figure 2:
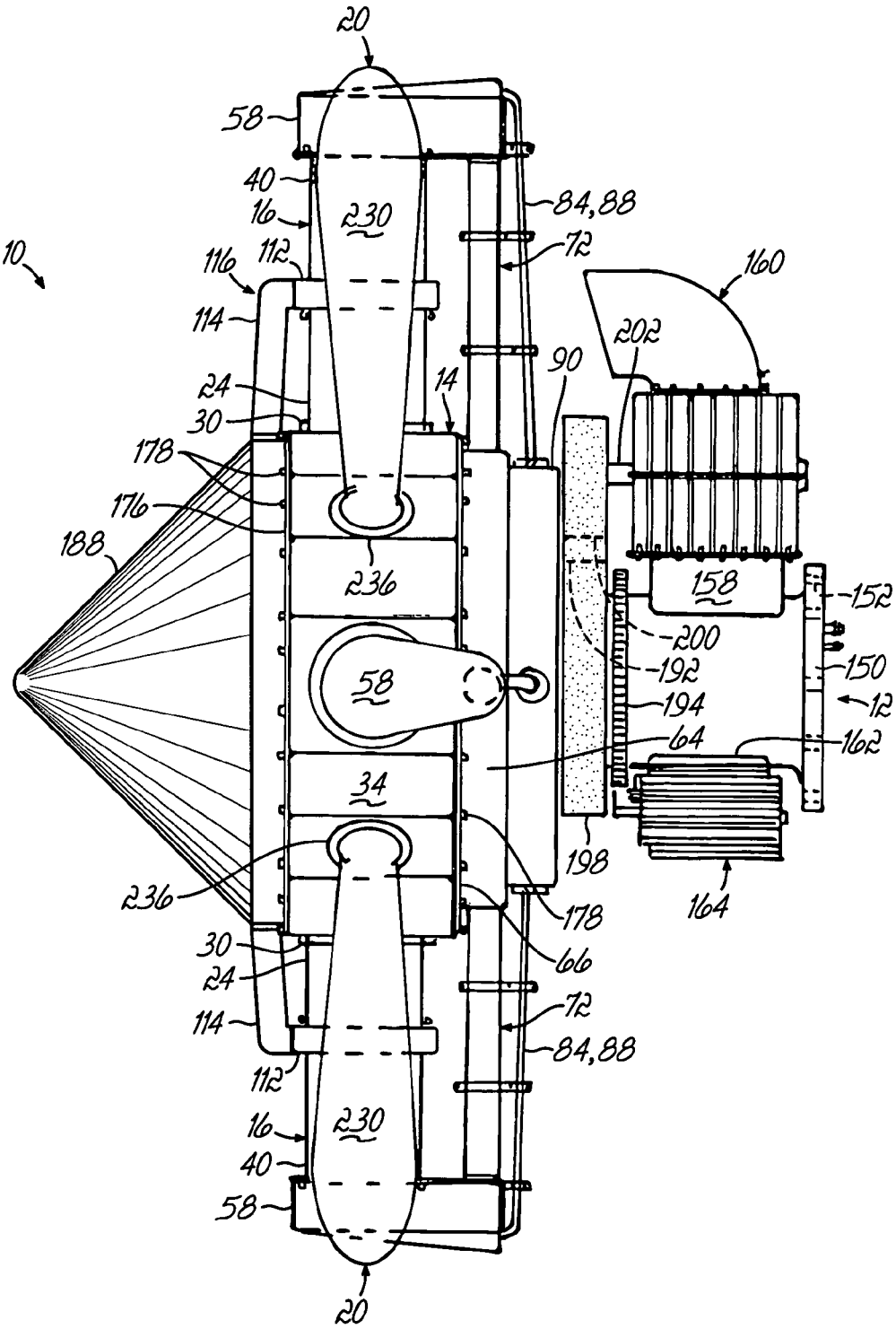
FIG. 2 is a schematic view showing the side of the engine of FIG. 1.
Figure 3:
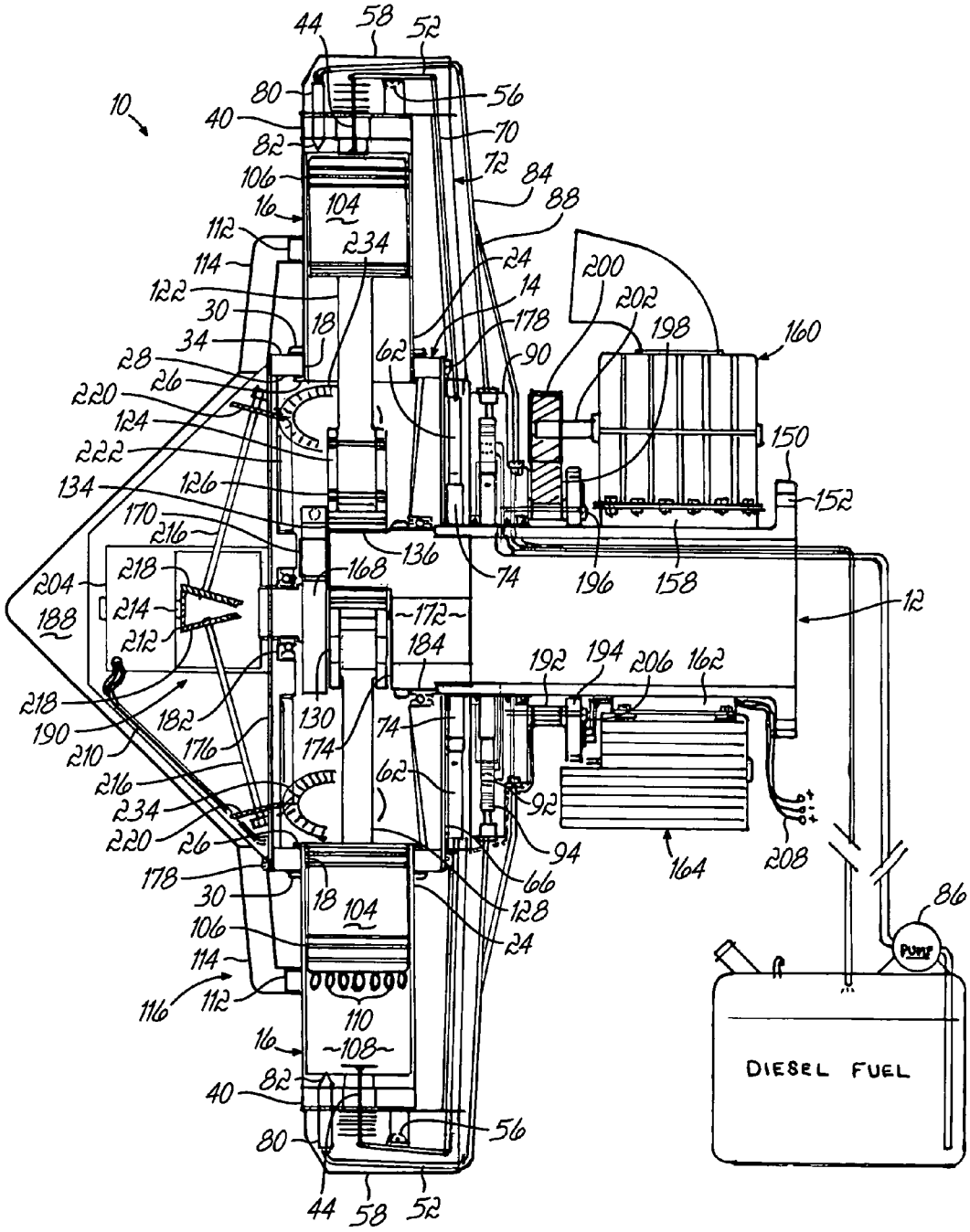
FIG. 3 is a schematic view similar to FIG. 2 showing the internal components of the engine of FIG. 1.

With reference to FIGS. 1 through 3, an engine 10 according to the invention is shown. The engine 10 generally comprises a crankshaft 12, a crankcase 14, and a plurality of cylinders 16 radially extending through a plurality of ports 18 formed in the crankcase 14. While four such cylinders 16 are shown in the figures, those of ordinary skill in the art will recognize that fewer or more cylinders may be used in the invention. The crankshaft 12 is fixed to a portion of a vehicle, such as an aircraft (not shown), and is stationary, while the crankcase 14 and cylinders 16 are adapted to rotate about the stationary crankshaft 12. Thus, unlike traditional engines where the engine body is stationary and the crankshaft rotates, the engine 10 is a Gnome-type engine in which the crankshaft 12 remains stationary and the engine body, or crankcase 14, rotates. In this manner, the crankcase 14 operates as a relatively large-massed flywheel capable of dampening significant vibrations. A plurality of propellers 20 may be secured to the rotatable crankcase 14 to power the aircraft, as will be described in greater detail below. Again, while four such propellers 20 are shown in the figures, those of ordinary skill in the art will recognize that fewer or more propellers may be used in the invention.

Figure 4:
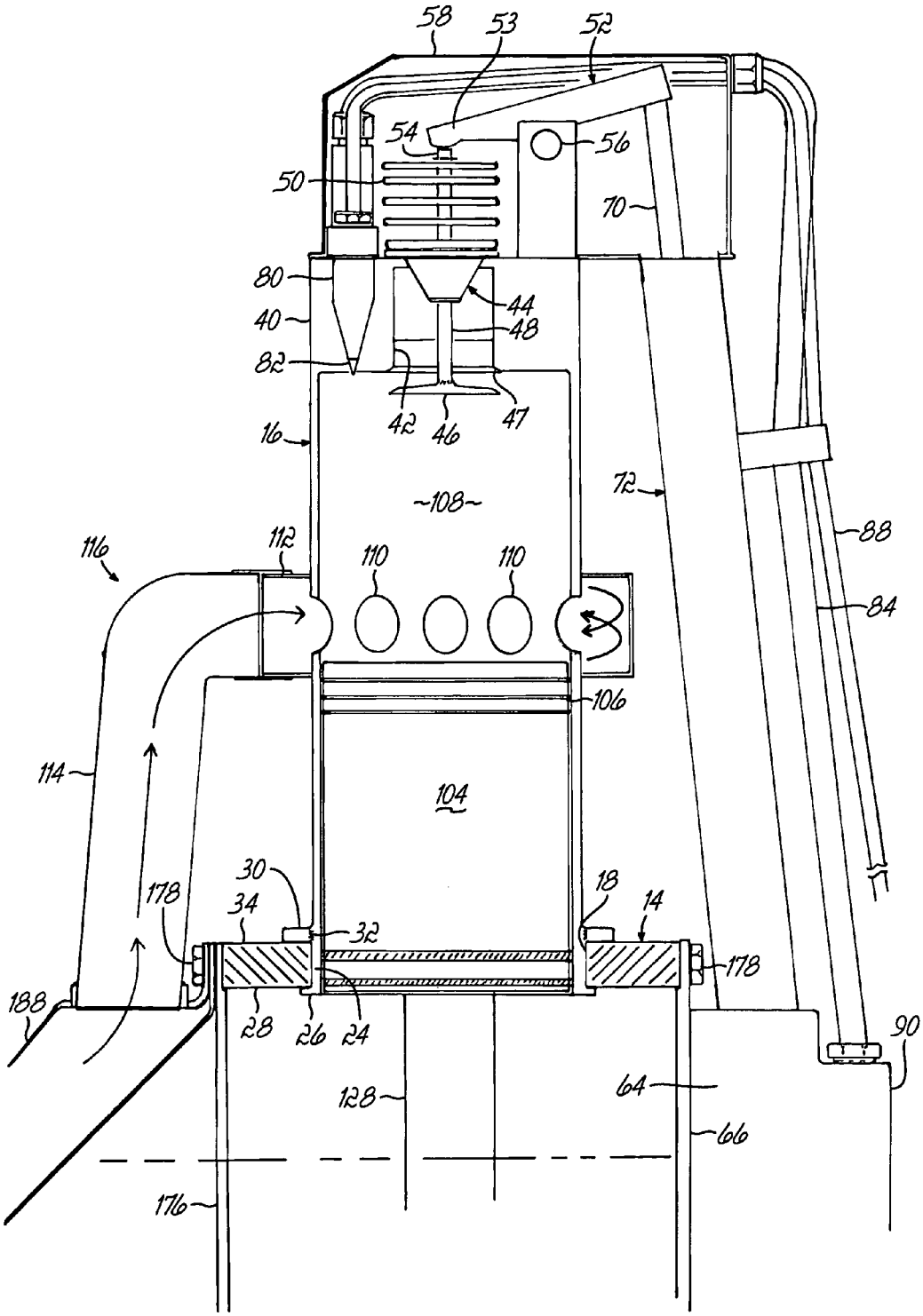
FIG. 4 is a schematic view showing the internal components of an engine cylinder in further detail.

The crankcase 14 is of a unitary construction and may be formed from a one-piece round seamless steel tube. The one-piece construction increases structural integrity and reduces crack initiation and other failure sites. The tube is preferably balanced (i.e., symmetric) in order to prevent or reduce engine vibration during the rotation of the crankcase 14. As shown in FIG. 1, the cylinders 16 are positioned in a symmetric manner about the periphery of the crankcase 14. The cylinders 16 are also of a unitary construction and may be formed from a one-piece round seamless steel tube. More specifically, the cylinders 16 are formed from a solid steel tube that has been machined to form the various bores for receiving the pistons 104, valve elements 44, and fuel injectors 80, as seen in FIG. 4. Such a design eliminates the two-piece construction of traditional cylinders and as such eliminates the need for heavy cylinder heads, cylinder head bolts, and head gaskets. In addition to reducing the overall weight of the engine, such a design also eliminates some of the most common sources of failure associated with two-piece cylinders (e.g., blown head gaskets). This is particularly important in CI engines, which experience significant pressures within the cylinders due to the relatively high compression ratios. The cylinders 16 do not require liquid cooling but may be air cooled. Thus, during flight the air stream passing over the cylinders 10 sufficiently cools the engine 10. Moreover, during periods when an aircraft is not moving or moving slowly, such as when on the taxi way, the rotation of the cylinders 16 provides cooling for the engine 10.

With reference to FIG. 4, one of the cylinders 16 is shown in further detail. The cylinders 16 are installed by passing them through the ports 18 from the interior of the crankcase 14. Each cylinder 16 is provided with a bottom flange 26 in order to prevent the cylinders 16 from extending completely through the ports 18. To this end, the bottom flanges 26 retain the cylinders 16 against an inner wall 28 of the crankcase 14 such that the bottom end 24 of each cylinder 16 is generally exposed to the interior of crankcase 14. In order to secure the cylinders 16 to the crankcase 14, a fastener 30 engages threads 32 provided on the outside of each cylinder 16. For example, the fastener 30 may be a one-piece threaded hex nut. The fastener 30 is tightened about the cylinder 16 until it firmly presses against an outer wall 34 of the crankcase 14. Thus, the bottom flanges 26 and fasteners 30 "clamp" the crankcase 14 so that an air-tight seal is formed between each cylinder 16 and the crankcase 14.

A top end, or "head" 40, of each cylinder 16 is provided with one or more bores 42 that are each adapted to receive an exhaust valve 44. The exhaust valves 44 may be passed from the interior of the crankcase 14, through the ports 18, and into the cylinders 16 before being received in the bores 42. As shown in FIG. 4, each exhaust valve 44 generally comprises a valve element 46 adapted to mate with a valve seat 47 in the cylinder 16, a stem 48, and a spring element 50. The stem 48 extends through the bore 42 and is adapted to reciprocate therein to bring the valve element 46 into and out of contact with the valve seat 47 so as to open and close the exhaust valve 44. More specifically, a rocking lever 52 is mounted to the head 40 of each cylinder 16 and has a first end 53 operatively connected to an end 54 of the stem 48. The rocking lever 52 pivots about a pin 56 in order to move the stem 48 into the cylinder 16 and create an opening between the valve element 46 and valve seat 47, and thus allows exhaust gases to be expelled from the cylinder 16. The rocking lever 52 also pivots about the pin 56 to move the stem 48 out of the cylinder 16 and engage the valve element 46 with the valve seat 47. Accordingly, the exhaust valve 44 has a closed position in which the valve element 46 contacts the valve seat 47 and seals off the bore 42, and an open position in which the valve element 46 is separated from the valve seat 47 such that the bore 42 is exposed to the interior of the cylinder 16. The rocking lever 52, pin 56, and spring element 50 are all housed within an exhaust valve cover 58 coupled to the head 40 of each cylinder 16.

Figure 7:
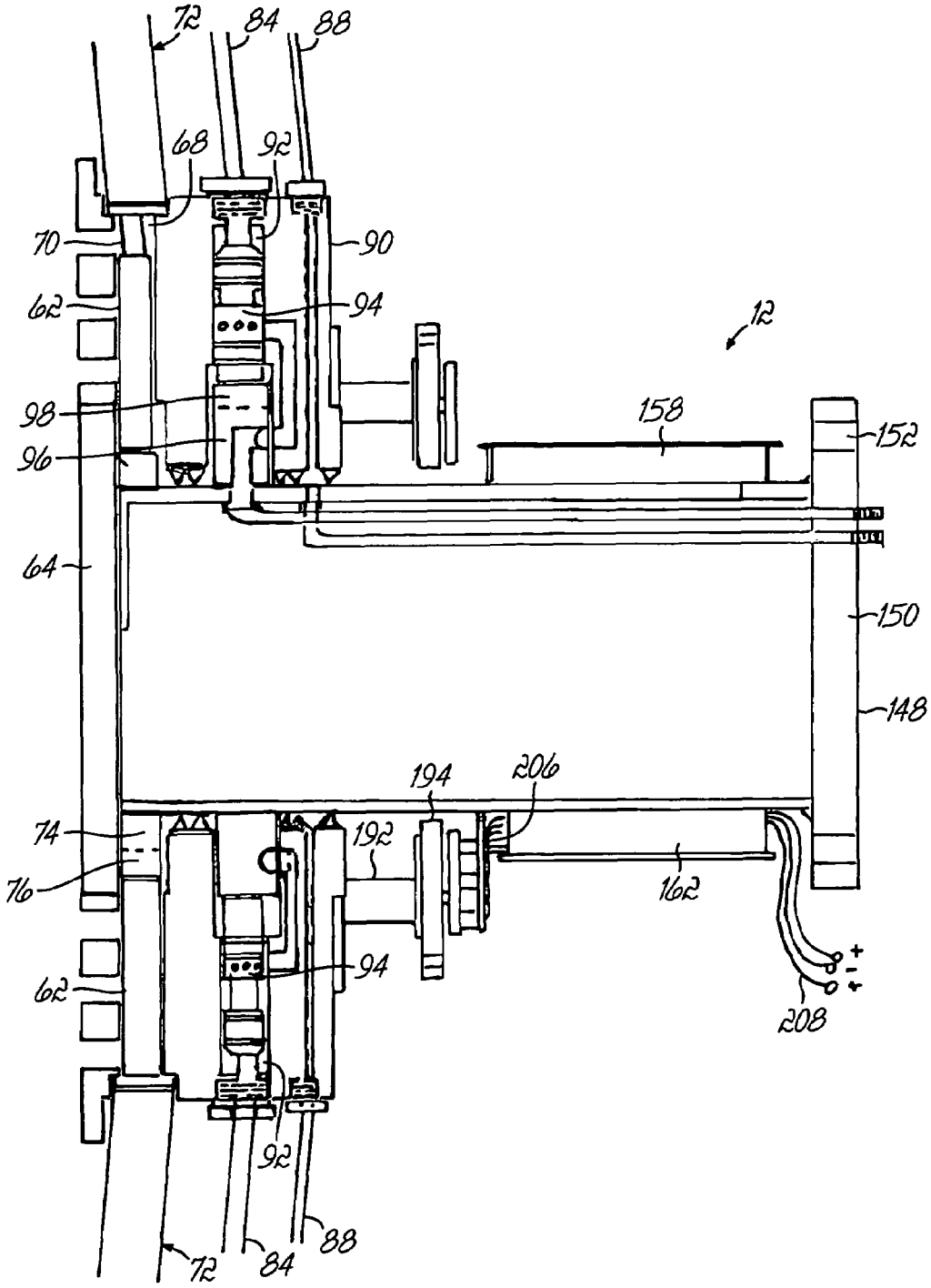
FIG. 7 is a schematic view showing the operation of first and second cams according to the invention.

With reference to FIGS. 3 and 7, the pivotal movement of each rocking lever 52 is controlled by a valve tappet 62 associated with each exhaust valve 44. The valve tappets 62 are positioned in a valve housing 64 mounted to a rear end, or rear thrust plate 66, of the crankcase 14. The valve tappets 62 are adapted to reciprocate in respective sockets 68 provided in the valve housing 64, and may include respective push rods 70 for operatively connecting the valve tappets 62 to the rocking levers 52. To this end, the exhaust valves 44, valve tappets 62, and valve housing 64 form an exhaust valve assembly 72 for expelling exhaust gases from the interior of the cylinders 16. As will be described in greater detail below, the valve tappets 62 are adapted to cooperate with a first cam 74 on the crankshaft 12 in order to actuate the exhaust valves 44 in a timed manner as the cylinders 16 rotate about the crankshaft 12.

Referring back to FIG. 4, the head 40 of each cylinder 16 is also adapted to receive a fuel injector 80. Each fuel injector 80 includes a nozzle 82 that extends into the interior of an associated cylinder 16. Additionally, each fuel injector 80 communicates with an intake fuel line 84 that receives fuel from an external fuel pump 86 and an outtake fuel line 88 that returns fuel to the external fuel pump 86. The intake and outtake fuel lines 84, 88 extend from the fuel injectors 80 to a fuel assembly housing 90, which is coupled to the valve housing 64 or the rear thrust plate 66. As shown in FIGS. 3 and 7, the fuel assembly housing 90 contains sockets 92 for aligning respective fuel pump plungers 94, which control the amount of fuel supplied to the intake fuel lines 84. Much like the valve tappets 62, the fuel pump plungers 94 are adapted to cooperate with a second cam 96 on the crankshaft 12 to operate the fuel injectors 80 in a timed manner as the cylinders 16 rotate about the crankshaft 12. This aspect of the invention will also be discussed in greater detail below.

After installing the exhaust valves 44 and fuel injectors 80, a piston 104 may be inserted into the interior of each cylinder 16. Each piston 104 is provided with seal rings 106 to form a combustion chamber 108 within the cylinder 16 by sealing off a portion of the interior of each cylinder 16 from the interior of the crankcase 14. Because the pistons 104 are adapted to reciprocate within cylinders 16, the volume of the combustion chamber 108 constantly changes during operation. As shown in FIG. 4, the cylinders 16 are provided with one or more air intake ports 110 that communicate with the combustion chamber 108 when the piston 104 is positioned at its bottom most position during its reciprocal motion. The air intake ports 110 are enclosed by an air chamber 112 coupled to the exterior of each cylinder 16. Each air chamber 112 is also coupled to a respective air delivery pipe 114 so as to collectively form an air manifold 116 for supplying pressurized air to the combustion chambers 108.

Figure 5:
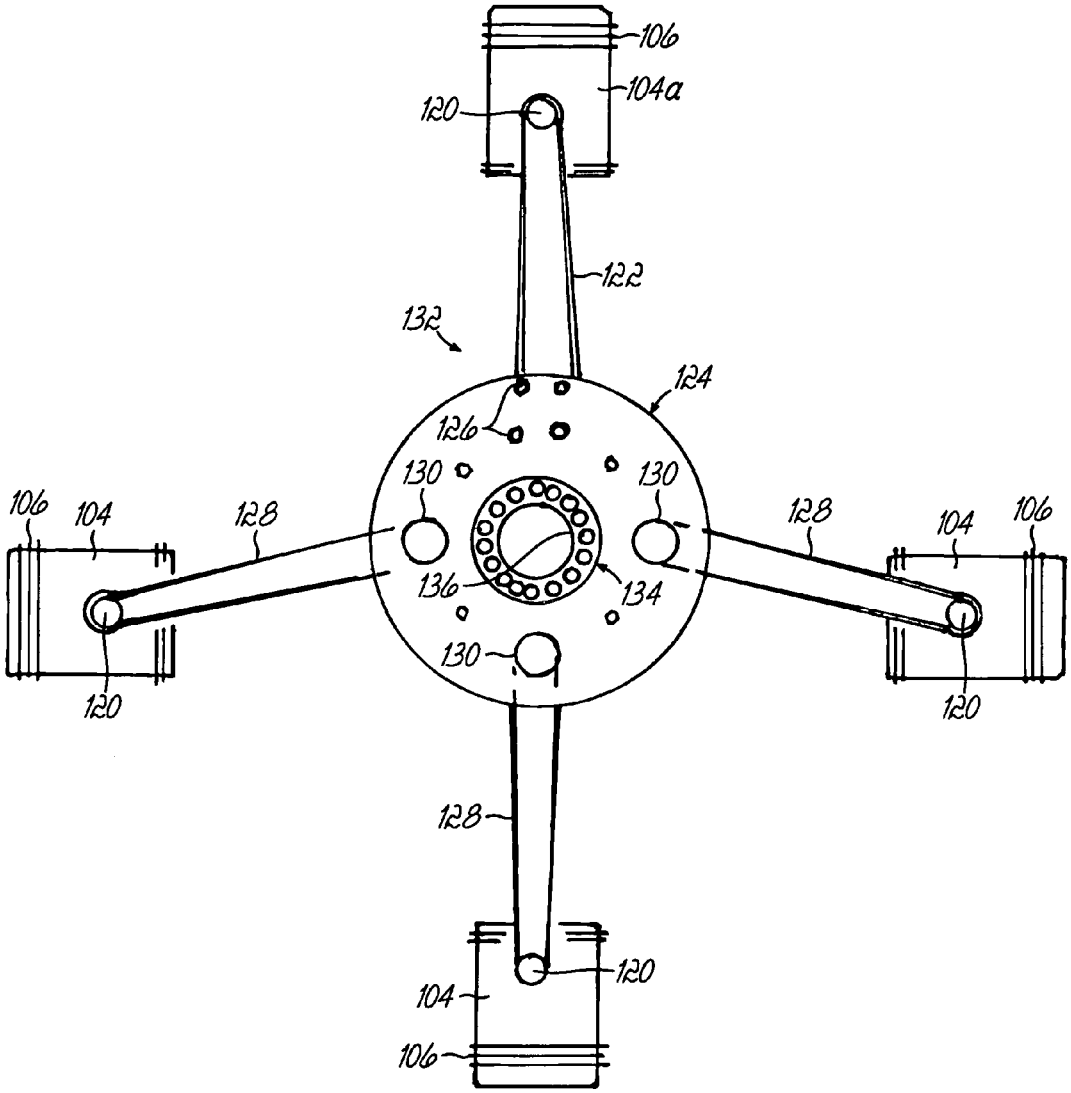
FIG. 5 is a schematic view of pistons and connecting rods according to the invention.

FIG. 5 illustrates the pistons 104 in further detail. In one embodiment, wrist pins 120 pivotally connect a first piston 104*a* to a master connecting rod 122, which in turn is fixed to a connecting rod cap 124 by bolts 126 or the like. The wrist pins 120 also pivotally connect the three other pistons to respective connecting rods 128, which in turn are pivotally connected to the connecting rod cap 124 by wrist pins 130. Thus, the first piston 104*a*, the master connected rod 122, and the connecting rod cap 124 collectively form master rod assembly 132 to which the other pistons are pivotally mounted. The connecting rod cap 124 is adapted to rotate about a main bearing 134, which includes an aperture 136 for receiving a portion of the crankshaft 12.

Figure 6A:
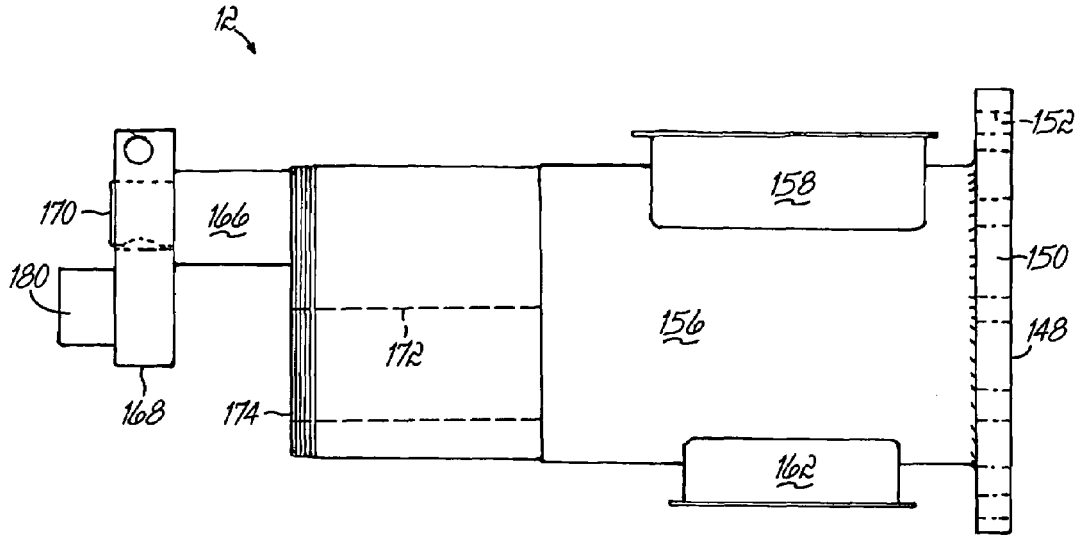
FIGS. 6A and 6B are schematic views showing a crankshaft assembly according to the invention.
Figure 6B:
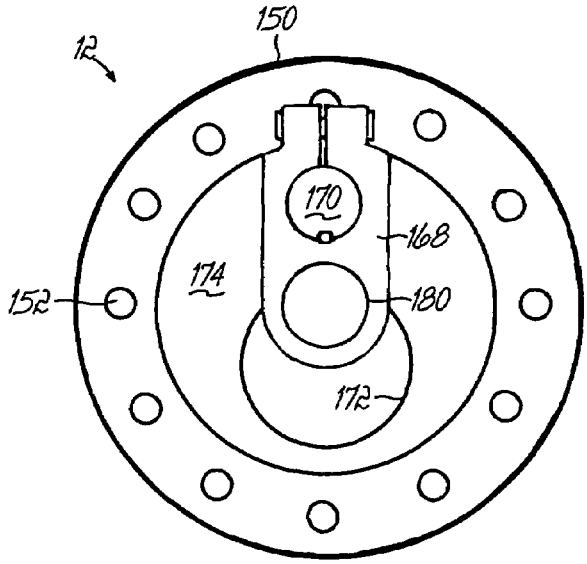

With reference to FIGS. 6A and 6B, the crankshaft 12 is shown in further detail. In one embodiment, a rear end 148 of the crankshaft 12 includes a flange 150 with bolt holes 152 in order to facilitate mounting the crankshaft 12 to the support or frame of the aircraft. Because the crankshaft 12 remains stationary with respect to the aircraft, such a configuration eliminates the need to dynamically balance the crankshaft 12 and thus helps reduce the overall weight of the engine 10. More specifically, such a configuration eliminates the need for balance dampeners and other heavy steel counterweights used to achieve a desired dynamic response (i.e., a response with low vibration).

The crankshaft 12 is preferably formed from a single piece of material, such as steel, that has been machined into the appropriate shape. As shown in FIG. 6A, the crankshaft 12 may include sections of various lengths and diameters in addition to the flange 150. For example, a first section 156 positioned adjacent the flange 150 has a relatively large diameter and includes a blower mount 158 for receiving an air blower 160 (FIG. 3) and a motor mount 162 for receiving a starter motor 164 (FIG. 3). The crankshaft 12 also includes a crankshaft throw 166 adapted to receive the main bearing 134 associated with the master rod assembly 132. Thus, after the pistons 104 are positioned into the cylinders 16 and connected to the connecting rod cap 124, the main bearing 134 and master rod assembly 132 may be placed onto the crankshaft throw 166 such that the cylinders 16 and crankcase 14 are disposed about the crankshaft 12. A positioning member 168 is removably mounted to a front end or nose 170 extending from the bearing section in order secure the main bearing 134 on the crankshaft 12. Also, the crankshaft 12 includes a hollow portion 172 extending from the blower mount 158 to a surface 174 adjacent the crankshaft throw 166 in order to provide an air passageway into the crankcase 14. Although the first cam 74 and second cam 96 are mounted to the exterior of the crankshaft 12 between the bearing crankshaft throw 166 and flange 150, the cams are not shown in FIGS. 6A and 6B for the sake of clarity.

Once the main bearing 134 has been installed onto the crankshaft 12, a forward thrust plate 176 (FIGS. 3, 4) may be secured to a forward end of the crankcase 14. Both the forward thrust plate 176 and rear thrust plate 66 are secured to the crankcase 14 with bolts 178 or the like. Also, the forward thrust plate 176 and rear thrust plate 66 may each be formed from a single piece of machined steel in order reduce the number of parts and overall weight associated with the crankcase 14. As shown in FIG. 3, the forward thrust plate 176 supports the crankcase 14 on a front portion 180 of the positioning member 168, while the rear thrust plate 66 supports the crankcase 14 on the crankshaft 12. A number of components help facilitate the rotation of the crankcase 14 about the crankshaft 12. For example, front bearings 182 are positioned between the forward thrust plate 176 and the front portion 180 of the positioning member 168, and rear bearings 184 are positioned between the rear thrust plate 66 and crankshaft 12. To keep the engine lubricated, crankcase 14 may be partially filled with a typical motor oil, e.g. 10W-30, to facilitate motion of the various parts. Unlike previous Gnome engines, the oil in the present engine is not mixed with the fuel and subsequently burned to power the engine. Instead, the oil is substantially retained within the crankcase 14 and reused for subsequent operation of the engine. Of course, the oil may be changed as needed or during regular maintenance of the engine.

Figure 8A:
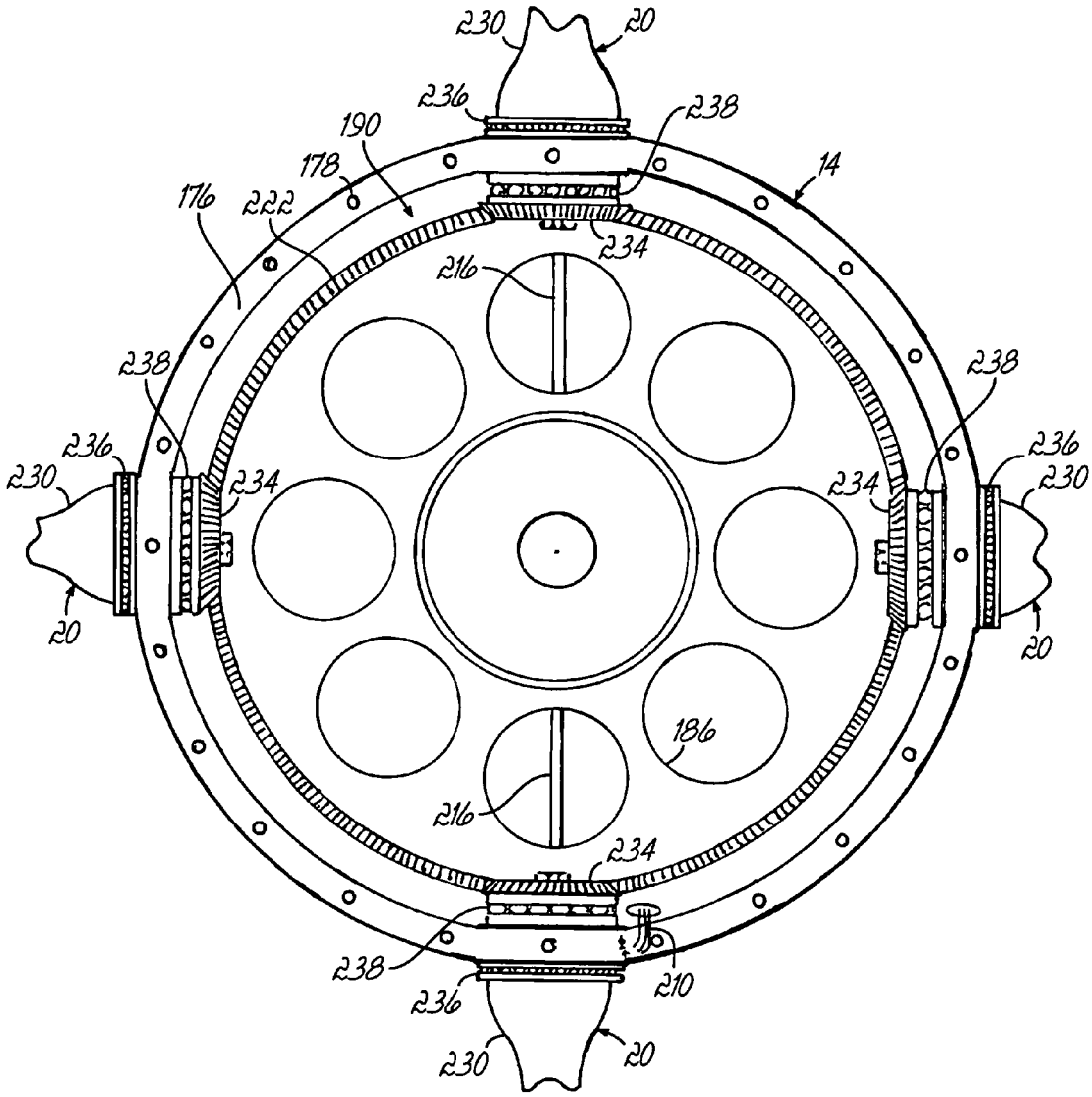
FIGS. 8A and 8B are schematic views showing a propeller synchronizer according to the invention.

The forward thrust plate 176 further includes a plurality of ports (not shown) similar to the plurality of ports 186 in main synchronizer gear 222 shown in FIG. 8A, to allow air to pass from the interior of the crankcase 14 to a spinner or nose cone 188, which is mounted to the forward thrust plate 176 and generally houses a propeller synchronizer 190. The spinner 188 rotates with the crankcase 14 and is adapted to supply air to the air delivery pipes 114. As shown in FIGS. 2 and 3, a pulley 192 and starter ring gear 194 are coupled to the fuel assembly housing 90 by bolts 196 or the like and are thus adapted to rotate with the crankcase 14 as well. A belt 198 operatively connects the pulley 192 to a pulley 200, which is coupled to the end of a drive shaft 202 that powers the air blower 160. Meanwhile, the starter motor 164 is adapted to selectively drive the starter ring gear 194.

Thus, in use, an operator activates the starter motor 164 to thereby drive the starter ring gear 194 and rotate the crankcase 14 about the crankshaft 12. As the crankcase 14 rotates, the pistons 104 reciprocate within the cylinders 16 and compress air in the combustion chambers 108 as they approach the cylinder heads 40. The nozzle 82 of the fuel injectors 80 sprays fuel into the combustion chambers 108 when the pistons 104 approach or reach the outer most position of their reciprocal movement. Eventually, the compressed air-fuel mixture reaches a kindle temperature sufficient to ignite the injected fuel such that the engine 10 begins operating independent of the starter motor 164.

The engine 10 shown in the figures operates on a two-stoke cycle. Thus, after the air-fuel mixture in the cylinder 16 is ignited, the resulting explosion causes the piston 104 to move downward and begin its power stroke. The downward motion of the piston 104 causes the cylinders 16 and crankcase 14 to rotate about the stationary crankshaft 12. As the piston 104 approaches its bottom most position in the cylinder 16, it moves below the air intake ports 110 so that high-pressured air can be delivered into the cylinder 16. More specifically, the air blower 160 forces pressurized air through the hollow portion 172 of the crankshaft 12 and into the interior of the crankcase 14. The air blower 160 is preferably a "Roots" type supercharger capable of supplying high pressure air to cylinders 16 during, for example, low altitude idling as well as high altitude, full power operation. From hollow portion 172, the pressurized air travels through the ports 186 in the main synchronizer gear 222 and through the ports in the front thrust plate 176 and into the spinner 188, eventually reaching the air delivery pipes 114 before being supplied to the air chambers 112.

Just prior to the air intake ports 110 becoming exposed to the combustion chamber 108, the respective valve tappet 62 contacts a lobe 76 (FIG. 7) on the first cam 74 in order to actuate the rocking lever 52 and open the exhaust valve 44. The pressurized air entering the combustion chamber 108 then forces exhaust gases out of the cylinder 16 and into the atmosphere so that the combustion chamber 108 is filled with fresh air. As the crankcase 14 continues to rotate about the crankshaft 12, the valve tappet 62 moves away from the lobe 76 on the first cam 74 to close the exhaust valve 44 and the piston 104 begins its compression stroke to seal off the air intake ports 110 from the combustion chamber 108.

The second cam 96 on the crankshaft 12 controls the operation of the fuel injectors 80 at the end of the compression stroke. In other words, as the piston 104 nears the top most position of its compression stroke, the fuel pump plunger contacts a lobe 98 (FIG. 7) on the second cam 96 in order to cause fuel to be injected into the compression chamber 108 via the nozzle 82. The fuel supplied to the intake lines 84 may be any fuel suitable for a compression-ignition engine, but is preferably diesel fuel. Because the pressure and temperature of the air-fuel mixture within the combustion chamber 108 results in another explosion, this two-stroke cycle is repeated in a timed manner as the crankcase 14 begins another revolution about the crankshaft 12.

Such an engine design provides several advantages that help address the challenges associated with conventional CI engines. By operating on a two-stroke cycle, the engine 10 is provided with a simplified construction that helps reduce its overall weight. For example, the engine 10 does not require intake valves and other components traditionally associated with four-stroke engines. Additionally, the two-stroke cycle ensures that the engine 10 fires each cylinder 16 once per revolution of the crankcase 14, instead of once per every other revolution as with four-stroke engines. The result is a power-to-weight ratio that makes it feasible to use the engine 10 to power the propellers 20 of an aircraft.

Figure 8B:
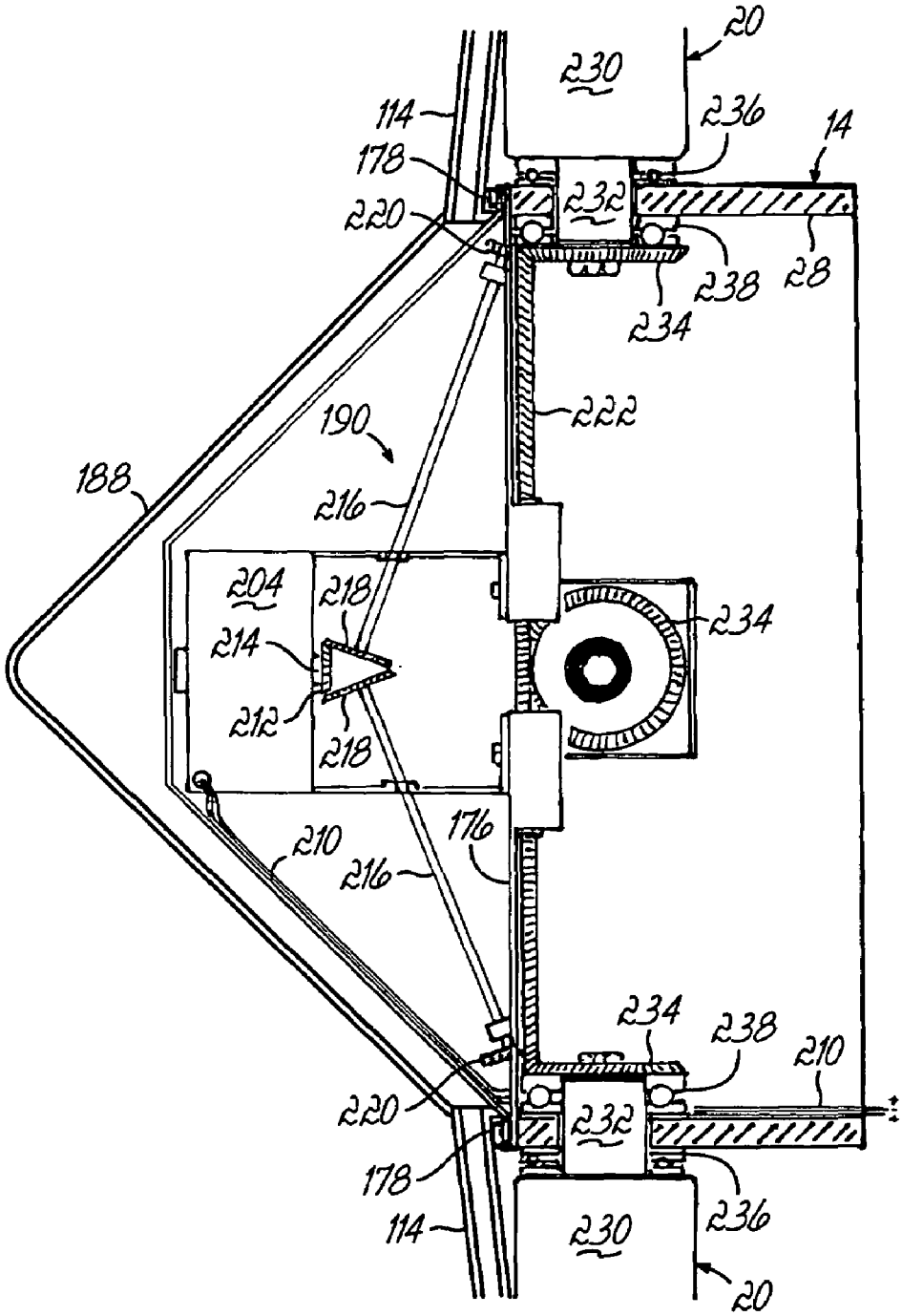

The propeller synchronizer 190 will now be described in further detail. As shown in FIGS. 8A and 8B, the propeller synchronizer 190 is generally positioned in the spinner 188. More specifically, the propeller synchronizer 190 includes a motor 204 positioned within the spinner 188 and secured to the forward thrust plate 176 opposite the interior of the crankcase 14. The motor 204 may be driven by any suitable power source, such as an electric generator or battery storage system located on the aircraft. Because the motor 204 rotates with the forward thrust plate 176 and crankcase 14, the engine 10 includes a slip ring assembly 206 (FIG. 7) for transferring power from the stationary support of the aircraft. For example, suitable wires 208 are positioned through the support of the aircraft and the stationary crankshaft 12. The stationary wires 208 transfer power to the slip ring assembly 206, which in turn transfers power to control wires 210 that are electrically coupled thereto. The control wires 210 are adapted to rotate with the crankcase 14 and are routed through the crankcase 14 in order to supply power to the motor 204.

Still referring to FIGS. 8A and 8B, the propeller synchronizer 190 further includes a pinion gear 212 drivingly coupled to the motor 204 via a drive shaft 214. The motor 204 is capable of rotating the drive shaft 214 and pinion gear 212 in a clockwise or counterclockwise direction, depending on the signal received from the pilot. Drive shafts 216 are coupled to the pinion gear 212, each drive shaft 216 having a gear at both of its terminating ends. More specifically, a gear 218 on one end of each drive shaft 216 mates with the pinion gear 212 such that rotation of the pinion gear 212 rotates both of the drive shafts 216. A gear 220 at the opposite end of each drive shaft 216 mates with a main synchronizer gear 222, which is positioned within the crankcase 14 and adapted to rotate relative to the crankcase 14. Thus, the drive shafts 216 drivingly couple the pinion gear 212 to the main synchronizer gear 222 such that the motor 204 is capable of rotating the main synchronizer gear 222 in a clockwise or counterclockwise manner.

As shown in the figures, the propellers 20 each include a blade portion 230 extending from the crankcase 14 and a base portion 232 extending into the interior of the crankcase 14. A drive gear 234 is operatively connected to each base portion 232 and drivingly coupled to the main synchronizer gear 222. Whenever the drive gears 234 are rotated, the propellers 20 are rotated as well. Thus, when the motor 204 is activated, the pinion gear 212 rotates the drive shafts 216 and main synchronizer gear 222 to simultaneously turn the drive gears 234 and thereby adjust the pitch of the propellers 20. In order to facilitate the rotation or turning of the propellers 20, outer support bearings 236 are provided between the blade portion 230 of each propeller and the outer wall 34 of the crankcase 14. Likewise, inner support bearings 238 are provided between the drive gear 234 associated with each propeller 20 and the inner wall 28 of the crankcase 14.

The propeller synchronizer 190 advantageously allows the aircraft engine to operate at a constant angular velocity, i.e. revolutions per minute (rpm), at different altitudes and regardless of the aircraft airspeed. For example, the propeller synchronizer 190 may be used to automatically adjust the pitch of the propellers in order to accommodate the "thinner" air at higher altitudes. The propeller synchronizer 190 may also function as a safety feature that allows a pilot to "feather" the propellers to reduce drag during in-flight engine failure and to maintain better control of the aircraft to perform an emergency landing. Because the pitch may be adjusted in both a clockwise and counterclockwise direction, the pitch of the propellers may be advantageously reversed to help the aircraft stop on short runways.

While the invention has been illustrated by the description of one or more embodiments thereof, and while the embodiments have been described in considerable detail, they are not intended to restrict or in any way limit the scope of the appended claims to such detail. Additional advantages and modifications will readily appear to those skilled in the art. The invention in its broader aspects is therefore not limited to the specific details, representative apparatus and methods and illustrative examples shown and described. Accordingly, departures may be made from such details without departing from the scope or spirit of Applicant's general inventive concept.

What is claimed is:

1. A two-cycle internal combustion engine, comprising:

a stationary crankshaft fixed to a support of a vehicle;

a crankcase rotatable about the crankshaft, the crankcase having a unitary construction and a plurality of ports formed therein;

a plurality of cylinders radially extending through the plurality of ports in the crankcase, the plurality of cylinders each having a unitary construction adapted to withstand pressures associated with compression-ignition of a fuel;

a valve assembly, comprising:

an exhaust valve associated with each cylinder; and a valve tappet associated with each exhaust valve for operating the exhaust valve;

a fuel assembly, comprising:

a fuel injector associated with each cylinder; and a fuel pump associated with each cylinder for providing pressurized fuel to the fuel injectors; and an air blower mounted to the crankshaft and adapted to deliver pressurized air into the crankcase.

2. The engine of claim 1, wherein the crankshaft includes a first and second cam mounted thereon, the valve tappets adapted to cooperate with the first cam to operate the exhaust valves in a timed manner as the crankcase rotates about the crankshaft, and the fuel pumps adapted to cooperate with the second cam to provide pressurized fuel to the fuel injectors in a timed manner as the crankcase rotates about the crankshaft.

3. The engine of claim 2, further comprising:

a valve housing coupled to the crankcase and having a plurality of sockets for aligning the valve tappets with the first cam on the crankshaft; and a fuel assembly housing coupled to the crankcase and having a plurality of sockets for aligning the fuel pump with the second cam on the crankshaft.

4. The engine of claim 2, wherein the first cam on the crankshaft has only one lobe for cooperating with the valve tappets such that each exhaust valve operates once per revolution of the crankcase about the crankshaft.

5. The engine of claim 2, wherein the second cam on the crankshaft has only one lobe for cooperating with the fuel pump such that each fuel injector operates once per revolution of the crankcase about the crankshaft.

6. The engine of claim 1, wherein the crankcase is formed from a seamless steel tube.

7. The engine of claim 1, wherein each cylinder is formed from a seamless steel tube.

8. The engine of claim 1, further comprising:

a drive belt coupling the air blower and the crankcase such that the air blower is powered by the rotation of the crankcase.

9. The engine of claim 1, wherein the crankshaft is hollow to allow the pressurized air from the air blower to be delivered into the crankcase.

10. The engine of claim 9, further comprising:

an air manifold adapted to deliver the pressurized air from the crankcase into the plurality of cylinders.

11. The engine of claim 1, further comprising:

a starter motor mounted to the crankshaft and selectively coupleable to the crankcase, the starter motor adapted to rotate the crankcase when coupled thereto.

12. The engine of claim 1, wherein the engine operates on diesel fuel.

13. The engine of claim 1, further comprising:

a plurality of propellers radially extending from the crankcase, the plurality of propellers having a pitch; and a propeller synchronizer adapted to selectively change the pitch of the plurality of propellers.

14. The engine of claim 13, wherein the propeller synchronizer comprises:

a motor secured to the crankcase;

a pinion gear rotatably coupled to the motor;

a main gear operable to rotate relative to the crankcase and coupled to each propeller; and a drive shaft coupling the pinion gear to the main gear such that operation of the motor causes rotation of the propellers so as to change their pitch.

15. A diesel-powered internal combustion engine, comprising:

a stationary crankshaft adapted to be fixed to a support of a vehicle;

a crankcase adapted to rotate about the crankshaft, the crankcase having a unitary construction and a plurality of ports formed therein;

a plurality of cylinders radially extending through the plurality of ports in the crankcase, the plurality of cylinders each having a unitary construction adapted to withstand pressures associated with compression-ignition of a fuel;

a plurality of propellers secured to and radially extending from the crankcase, the plurality of propellers having a pitch;

a propeller synchronizer adapted to selectively change the pitch of the plurality of propellers, the propeller synchronizer comprising:

a motor secured to the crankcase;

a pinion gear rotatably coupled to the motor;

a main gear operable to rotate relative to the crankcase and coupled to each propeller; and a drive shaft coupling the pinion gear to the main gear such that operation of the motor causes rotation of the propellers so as to change their pitch.

16. The engine of claim 15, further comprising:

a valve assembly comprising an exhaust valve associated with each cylinder and a valve tappet associated with each exhaust valve for operating the exhaust valve; and a fuel assembly comprising a fuel injector associated with each cylinder and a fuel pump associated with each cylinder for providing fuel to each cylinder, wherein the valve assembly and the fuel assembly are adapted to be operated in a timed manner as the crankcase rotate about the crankshaft.

17. The engine of claim 16, wherein the timed manner of the valve assembly and the fuel assembly corresponds to a two-stroke combustion cycle.

18. The engine of claim 15, wherein at least one of the crankshaft and cylinders is formed from a seamless steel tube.

19. The engine of claim 15, further comprising:

an air blower mounted to the crankshaft and adapted to deliver pressurized air into the crankcase; and an air manifold adapted to deliver the pressurized air from the crankcase into the plurality of cylinders.

* * * * *